US005146045A

United States Patent [19]

Cordell

[11] Patent Number: 5,146,045

[45] Date of Patent: Sep. 8, 1992

[54] UNDERWATER MINE

[76] Inventor: Steve Cordell, 3317 Cardiff Ave., Los Angeles, Calif. 90034

[21] Appl. No.: 671,427

[22] Filed: Mar. 20, 1991

Related U.S. Application Data

[63] Continuation-in-part of Ser. No. 537,128, Jun. 13, 1990, abandoned.

[30] Foreign Application Priority Data

Jun. 21, 1989 [DE] Fed. Rep. of Germany ..... 3920187

[51] Int. Cl.[5] ..... F42B 1/00; F42B 22/00

[52] U.S. Cl. ..... 102/406; 102/293; 102/402; 102/416; 367/1

[58] Field of Search ..... 367/1; 102/401, 402, 102/406, 411

[56] References Cited

U.S. PATENT DOCUMENTS

| | | | |
|---|---|---|---|
| 1,331,510 | 2/1920 | Lackner | 102/293 |
| 2,975,396 | 3/1961 | Mueller | 367/1 |
| 3,084,627 | 4/1963 | Holm | 102/411 |
| 3,771,115 | 11/1973 | McLinden | 367/1 |
| 3,838,642 | 10/1974 | Shimberg | 102/411 |
| 4,123,974 | 11/1978 | Mutsch et al. | 102/411 |
| 4,131,064 | 12/1978 | Ryan et al. | 102/293 |
| 4,838,166 | 6/1989 | Spies et al. | 102/481 |
| 4,953,465 | 9/1990 | Hightower | 102/406 |

*Primary Examiner*—David H. Brown

*Attorney, Agent, or Firm*—Dickstein, Shapiro & Morin

[57] ABSTRACT

The invention relates to an underwater mine or decoy which should lie on the ocean bottom or which has buoyancy characteristics. The mine or decoy is made up of at least an expandable material and a foldable, preferably webbed shell which determines the external form of the mine. The disadvantages associated with the storage, transportation and stowage of heavy mines of fixed shape in submarines, small ships and aircraft are thereby avoided. It is possible to manufacture decoys or mines rapidly and economically, and they may have variable magnetic and/or sonar reflecting properties. The release of the decoys or mines from submerged submarines via forceful ejection is possible.

13 Claims, 8 Drawing Sheets

UNDERWATER MINE

CROSS REFERENCE TO RELATED APPLICATIONS

This application is a continuation-in-part of application Ser. No. 07/537,128 filed Jun. 13, 1990, which is now abandoned.

BACKGROUND OF THE INVENTION

The present invention relates to an underwater mine or to an underwater mine decoy which should lie on the ocean bottom or which has buoyancy characteristics.

Underwater mines customarily have a hard, normally ferromagnetic shell, among other things, in order to withstand the pressure in the ocean depths. They have, therefore, given sizes. Known, however, from Hightower, U.S. Pat. No. 4,953,465 is a flexible, inflatable mine suitable for use as a bottom mine for low depths and pressures. Also known are underwater mines which can move or which have an outer covering which absorbs sonar signals.

SUMMARY AND OBJECTS OF THE INVENTION

It is therefore an object of the invention to eliminate the problems associated with the storage, transportation and stowage of mines of fixed size and shape in submarines, small ships and aircraft. Further, it shall be economical, rapid and simple to deploy underwater mine decoys or, as the case may be, underwater mines. Further, it shall be possible to deploy underwater mines or decoys with ferromagnetic or sonar-reflective properties which may be varied at the point of use to adapt to the local conditions, and the underwater laying of such mines while at high speed, e.g. from a submarine performing escape manoeuvres, or according to a predetermined minefield plan with a significantly improved relocating capability.

The foregoing objects are achieved by the present invention, which provides that the mine be constructed by using at least an expandable material and a foldable material, the final shape of the mine being determined by the expansion of the expansion material and the expansion limitations imposed by the outer shell. The only limitation on the folding of the mine in preparation for release is that imposed by the expandable materials, as well as those imposed by the other components of the mine as specified below. The advantage is the ease of transporting a low volume mine or decoy, whose final form is only achieved after it has been released.

Further, the present invention achieves the foregoing objects by using an expandable material which expands on contact with saltwater, and using preferably a webbed material for the outer shell. The advantage is that the mine requires no additional mechanism to achieve its final form, and that the webbed external shell represents a simple, but a the same time an extraordinarily strong element, which limits expansion of the expandable material, said material and said shell together determining the outer form. Mutsch et al., U.S. Pat. No. 4,123,974, describes the use of netting to restrain "to some extent" the plastic explosive material while it assumes its natural shape on the ocean floor under influence of water pressure and gravity.

Further, the present invention achieves the foregoing objects by using said expandable material which expands due to a sudden pressure differential. The advantage is that a mine which is under enormous pressure, when forcefully released, will expand or inflate immediately to its final form.

Further, the present invention achieves the foregoing objects by employing a steel, non-ferrous metal, or a plastic webbing material for the outer shell. The advantage is that, depending on the webbing of the outer shell, the mine is more or less ferromagnetic or sonar-reflecting, can break up due to rusting or degeneration, possesses better explosion characteristics, etc. As a plastic material, Kevlar (Trademark DuPont) is preferred for its strength and long-term stability in storage. To achieve better sonar-reflecting characteristics, the steel or nonferrous metal wires in one or both directions of the webbing network can have a more or less concentrated mesh. The same holds true for Kevlar mesh, but the fibers would be woven with sonar-reflecting substances such as silver thread.

Further, the present invention achieves the foregoing objects by designing the inside expanding material in such a manner that its final firmness under pressure corresponds to the water pressure, and the outer shell surrounding said inside expanding material corresponds to the minimum expansion pressure of said inside material. The advantage is that a mine can be selected from the available stock which is appropriate for the expected depth of the mission.

Further, the present invention achieves of the foregoing objects by employing for said expandable material a mixture of expandable material and explosive material. The advantage is that high explosive plastique material can be partly mixed with other materials; the expansion capability of the mixture with the expansion material is thereby not affected; likewise the explosion capability of the explosive is not affected when properly proportioned. If each mine or decoy is made up of this mixture, according to the present invention, the storage and transportation of the mine is easier. Only when a detonator is provided is a raw mine an underwater mine. Whether homogeneously combined in the mixture or placed within the expansion material in stripes or clump form, the plastique needs only to be protected from saltwater deterioration for a limited time; modern silicone products are acceptable for this task, either as a protective covering or emulsified with the constituents of the mixture. The use of pure plastique explosives exposed to seawater in a bottom mine is disclosed in Mutsch et al, U.S. Pat. No. 4,123,974.

Further, the present invention achieves the foregoing objects by employing for said expandable material a mixture of expandable material and iron powder, iron particles or a similar ferromagnetic material. The advantage is that a decoy can deceive a ferromagnetic detector. Ryan et al, U.S. Pat. No. 4,131,064, discloses a method of including foreign particles, so-called tagging particles, with objects such as explosives. In the instant case, the tagging is magnetic, as it is desired that the decoy be detected.

Further, the present invention achieves the foregoing objects by employing for said expandable material a mixture of expandable material and sonar reflecting material. The advantage is that a decoy can deceive a sonar detection device. Lengths of wide, flat, very thin silver ribbon can be used as a sonar-reflecting material within the mine.

Further, the present invention achieves the foregoing objects by employing said expandable material and mixing it with a ferromagnetic material in such a manner that the mine exhibits a ferromagnetic gradient from inside to outside. The advantage is that a decoy can deceive a detection device which can differentiate between types of ferromagnetic mines. Steel balls are preferred for this application, since the density of ferromagnetic material is decisive and balls are easy to handle.

Further, the present invention achieves the foregoing objects by employing said expandable material and mixing it with a sonar-reflecting material in such a manner that the mine exhibits a sonar transmission gradient from inside to outside. The advantage is that a decoy can deceive a detection device which can differentiate between types of sonar-reflecting mines. Silver ribbon with varying widths for the respective layers is a possible material. This method would render high speed mine recognition, using sonar alone, almost impossible; slow speed verification after detection, using television, would most certainly be necessary, thus slowing the mine-sweeping process.

Further, the present invention achieves the foregoing by employing, for the control of the various logical decisions within the mine, a programmable control device which is protected from the high water pressure. The advantage is that the role of the central controller for all logical functions of the mine can be a standard device, which is a part of each mine and decoy. This eases the problem of stocking, and only a specific part of the programming must be performed before the mine is released. In the military arsenals alone there are hundreds of different types of miniature, programmable controllers which would meet the requirements of the mine controller; a suitable controller can be found is smart land mines.

Further, the present invention achieves the foregoing objects by employing a device with a detonator and a detonation controller in combination with an amount of ferromagnetic and/or sonar reflecting material within the mine. The advantage is that after a pre-defined event, the device discharges the above mentioned material under very high pressure, so that the material partly mixes with the remaining material of the mine or decoy and at least partly penetrates the outer shell. This a required, due to international convention, in order to find mines and dangerous decoys at some later time. Disclosed in Mutsch et al., U.S. Pat. No. 4,123,974, are detonators of the type which could be used in the instant invention.

Further, the present invention achieves the foregoing objects by combining in the mine a compressed air container, or similar device, with one or more expandable containers. The advantage is that after a pre-defined event, the device releases the compressed air or gas in one or more expansion chambers, whereby the mine may then change its form and, according to a pre-programmed scheme, may rise slowly or rapidly to the surface. The disclosure of Holm, U.S. Pat. No. 3,084,627, describes a flotation method for mines for fixed form, whereby a bladder is used to displace water within the mine; the method is equally applicable for the instant invention.

Further, the present invention achieves the foregoing objects by combining within the mine an ejectable heavy weight and a connection between said weight and the rest of the mine. The advantage is that after a pre-defined event, the device releases the weight from the mine, or the weight is freed from the mine according to some other method. The freed mine is then free to rise to the end of a tether. The disclosure of Shimberg, U.S. Pat. No. 3,838,642, describes a method for releasing an external weight from a mine attached to it by a tether. Also described therein is a method for releasing the mine from the tether after some pre-defined event occurs.

Further, the present invention achieves the foregoing objects by employing within the mine a foldable spring construction within a cartridge or similar container, and whose unfolded form determines the final form of the mine. The advantage is that the spring construction unfolds immediately after release of the mine or according to some other criterium, e.g. after a pre-determined depth has been reached. This represents a very simple, economical underwater decoy; in its simplest form, it is made up of a sonar-reflecting shell of webbed plastic and a simple, folded spring construction.

An underwater mine or decoy, made up partly of formable material, is forcefully released from the hull of a submarine or a ship, or is otherwise released. This material expands under water according to a pre-determined scheme and takes on a pre-determined form. Before being ejected, the mine can have a soft, relatively formless shape, in order to easily put it into the ejection chamber and then under pressure. Methods of forceable ejection of decoys may be found in "Navy International", Submarine Signal & Decoy Ejector, Dec. 1990, page 483. In deep water, there exists an enormous pressure. The mine must be able to expand, without bursting, and should preferably lie on the ocean bottom, either partly or fully under the sand or bottom debris. A light, webbed and very strong material, e.g. Kevlar (Trademark DuPont) or webbed steel can be used as internal protection as well as for a multi-purpose skin or shell. The expansion of the formable material can be triggered, for example, by contact with salt water. The quantity of raw expandable material is determined by the expected depth where the mine will be deployed. An example of expandable material acceptable for use in saltwater is the bottled, highly compressed hard foam used in the building trade. A further example is the use of synthetic cotton materials (such as Kapok, formally used in lifevests), such materials being treated with silicones or similar coatings; they will expand slowly under heavy water pressure and will keep their shape until final expansion is complete and the mine has achieved its final form, after which the fiber coating may very slowly disintegrate.

When the outer and inner pressures on the mine are equal, due to perforations or holes in the mine material, a very simple spring construction, e.g. out of plastic and/or ferromagnetic material, could give the mine its final form. The spring construction is found within a cartridge inside the mine and unfolds, for example, only after some seconds in salt water.

The mine material can be either sonar absorbent or reflecting, ferromagnetic (e.g. mixed with iron power) or not, and could possess a sonar-transparent or a magnetic permeability gradient after the mine achieves its final form. Such gradients may be formed, for example, by employing concentric shells of webbing inside of the outer shell of the mine; inside the various snells would then be a different mixture of expandable material. Disclosed in Hightower, U.S. Pat. No. 4,953,465, are a number of methods for filling dry spaces within a sealed underwater mine with hard foam, or alternatively with foam mixed with other materials, including weighty materials or materials which detonate and smoke. These methods may be applied to the mine of the instant invention.

A mine whose expandable material is partly a mixture of plastique explosive could, via intelligent logic as well as sensors, either self-destruct, or could act as a true mine and according to a pre-programmed schemed either damage or destroy a ship or following submarine, or could at least force the vessel to detour.

It is possible, but not absolutely necessary, to manufacture the mine from a raw mine within a submerged submarine underway; the variable parts are the explosives and the detonator, the variable mixture and shells for creating the above mentioned gradients, the programmable logic, etc. Finished mines from the available stock need only be provided with the detonators, and the controllers must be programmed. Programming of the controllers is a fully automatic function; such variables as ocean depth, water temperature, depth of the submarine if the mine is to be released from a submerged submarine, etc. are transmitted to the computer. Additionally, the type of threat expected may be manually keyed into the programmer, among other things in order to set the sensitivity of the sensors. The captive torpedo in the U.S. military arsenal, the so-called Captor, is programmed in this manner as well. The release or ejection mechanism is similar to that used in submarines today to eject a wide variety of decoys, except that within the release chamber a high pressure may exist prior to release, in order to increase the pressure on the mine and to insure its rapid expansion after release. The cartridges of unexpanded roam or other expansion material are placed with the explosives (in case the device is to be a true mine and not a decoy) within the outer shell or within the concentric shells in case the method of gradient building is desired, and the mine is placed in the expansion chamber. The mine is then compressed, heated, or both, in order to allow said material to be released from said cartridges and to migrate somewhat within the shell or between the shells, as the case may be. On rapid expulsion of this formless mine, for example the mine having the approximate form of a solid cylinder, the expansion material can expand freely between the layers within its confinement space or spaces.

The mine can be fitted with a flotation capability. After some pre-programmed event, compressed air could be released from one vessel into an expanding part of the mine or into a balloon, whereby the mine could charge its form or could float upwards with a pre-determined speed, either to the limits of a tether or to the surface. Depending on the type of expansion capability of the air or gas container, the mine could repeat this maneuver. For example, a release valve would allow the gas to escape, would again be closed by the controller, and the balloon could again be expanded by the gas.

Depending on the combination of materials used for the mine, the mine could have pre-defined buoyancy characteristics, whereby the mine, after achieving its final form, could move away very slowly from its initial position. For example, compressed cork granules within water soluble capsules would serve to force the mine slowly upwards. The number of said capsules used would depend on the desired upward speed of the mine.

Other conventional and new mine elements, protected from the water pressure, such as a microphone-on-a-chip, batteries, miniature sonar devices, transmitters for information transmissions, etc. can be employed. An example of such mine elements can be found within the torpedo described on pages 1370–1371 in the International Defense Review, 12/1990. This is a so-called heavy weight torpedo and thus has sonar elements and processing units which, while miniaturized, are not of the miniature class envisioned for the mine of the present invention. High quality depth-finding devices sold commercially for private fishing boats could be very well adapted to the military role required by the mine in this instant disclosure, and do roughly meet the foreseen size and power requirements of the mine or decoy. The new, commercially available microphone-on-a-chip for undersea use is not known, but the miniaturized device would be ideally suited for detecting sounds in the low frequency spectrum of interest. In order to more easily locate a mine at some later time, the mine could give a command, at some pre-determined time, to detonate a device within the mine which would explosively distribute iron particles or similar material and/or sonar-reflecting material, which at least in part will penetrate the outer shell and mix with it. Such ragging of objects has been discussed above and referenced to a previous U.S. patent.

DESCRIPTION OF ILLUSTRATIVE EMBODIMENTS

Figure 1:
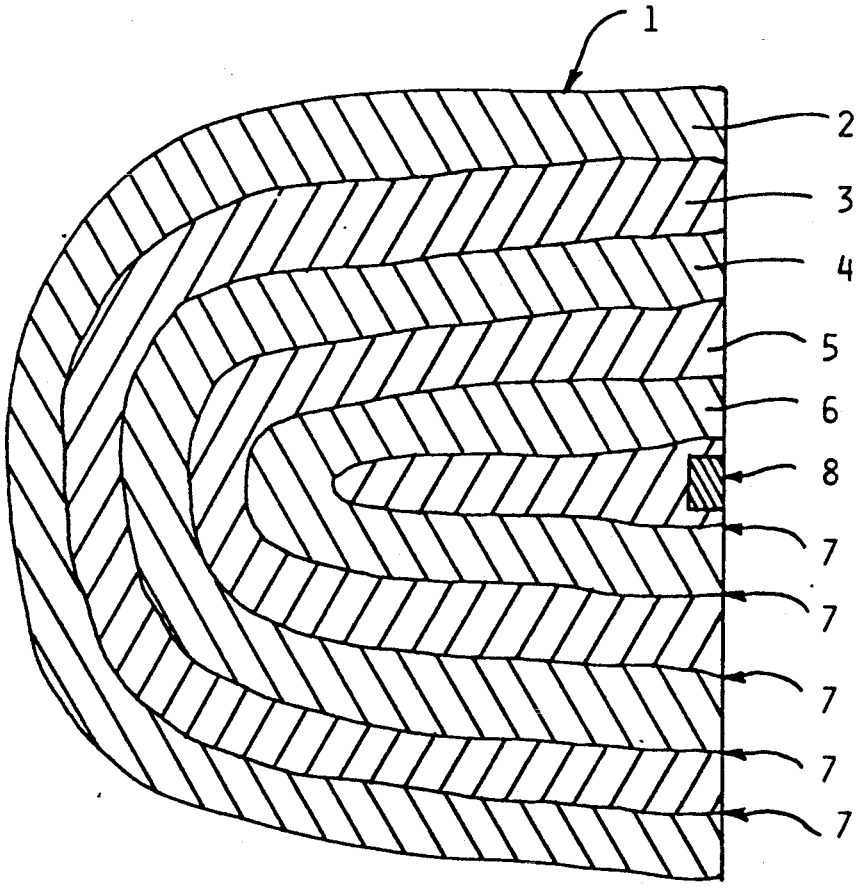
FIG. 1 is a cross-sectional view through the approximate center of an expanded mine at depth; only the left half is shown.

FIG. 1 illustrates an embodiment of a mine or decoy made up of concentric shells or containers showing sonar-reflecting gradient layers between the shells; the mine is in its expanded form underwater. In the figure, the mine has an outer shell 1 giving the mine its final shape in its completely expanded position under the influence of water pressure. The sections 2 through 6 represent concentric spaces filled with expansion material (and optionally mixed with plastique explosive material as well), these sections being kept in their relative positions by the concentric shells 7. The makeup of the material within these spaces exhibits a monotonic increasing proportion of sonar reflecting material from layers 2 through 6, whereby layer 6 has the greatest proportion of said material. The concentric shells of Kevlar 7 serve to contain the expansion pressure of said expansion material. In one of the possible embodiments, the space 8 at the approximate center of the mine illustrates the electronic control logic and detonator, as well as any weight necessary to counteract buoyancy of the mine. Since this control unit is small, may be shaped round, and as stated above must withstand extreme water pressure, it may be pressed out or ejected under pressure from the releasing vessel. In other embodiments of the mine, the weight may be ejectable and would thus occupy a position on or near the skin of the outer shell 1 (see the above reference to U.S. Pat. No. 3,838,642 for methods of storing and releasing a weight from a mine.) FIG. 1 is likewise illustrative of a mine exhibiting sonar-reflective or ferromagnetic gradient characteristics, said gradients occupying the spaces 2 through 6, respectively, as in the above example.

Figure 2:
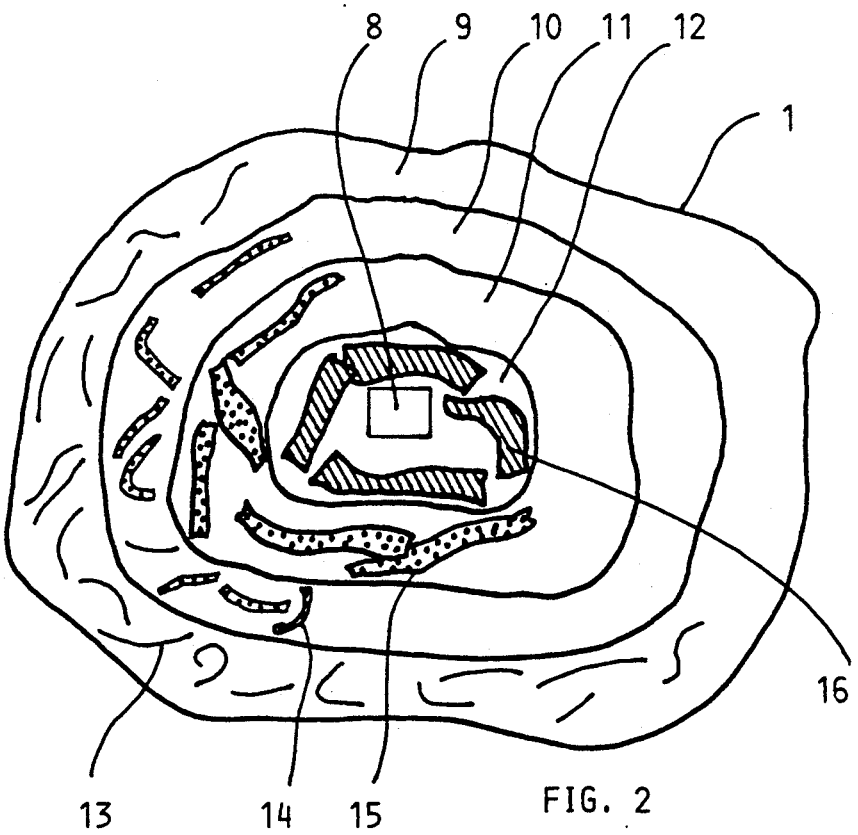
FIG. 2 a cross-sectional view of a mine similar to that of FIG. 1, illustrating a method of creating sonar reflecting gradients.

Spies et al, U.S. Pat. No. 4,838,166 discloses a method for protecting explosive charges by the use of several dissimilar layers of surrounding material. Although not applicable to the instant disclosure, it does indicate the method of using layers with different shock wave impedances; in the instant invention, the analog is the use of multiple layers with varying impedances, for example sonar-reflecting gradient, which is useful for deceiving an enemy at the location where mining is to be expected. This cross-sectional view is similar to the mine shown in FIG. 2, but only four concentric gradients 9, 10, 11 and 12 are illustrated for the mine with outer shell 1. As can be seen, the sonar-reflecting gradient with narrow, short strips of silver ribbon 13 is the outer concentric layer 9, which reflects sonar signal with the weakest echo. The inner concentric layer 12 contains wide, long strips or silver ribbon 16 and reflects sonar signals with the strongest echo. Layers 10 and 11, with increasing widths and lengths of silver strips 14 and 15, respectively, reflect sonar signals more strongly than layer 9 but less than layer 12; the echo from layer 11 is greater than from layer 10. The control logic and detonator in space 8 is as illustrated in FIG. 1 and of the type already described above. The expansion material is not shown in the figure, but its existence within the concentric layers keeps silver strips in their relative positions within their layer and therefore within the mine.

Figure 3:
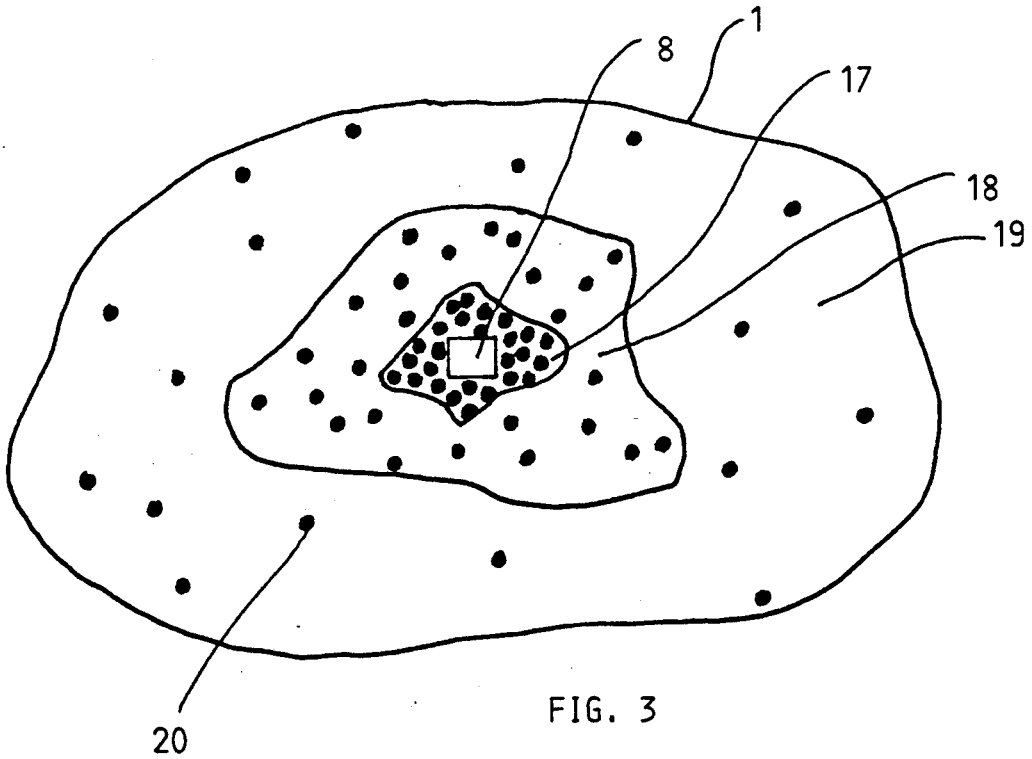
FIG. 3 illustrates a method of creating ferromagnetic gradients.

FIG. 3 illustrates one of the methods for creating a mine with ferromagnetic gradients from inside to outside, which is useful for deceiving an enemy. This cross-sectional view is similar to the mine shown in FIG. 2, but only three concentric gradients 17, 18 and 19 are illustrated for the mine with outer shell 1 and the control logic and detonator in space 8. Concentric layer 17 contains the greatest concentration of steel balls 20 within a small volume. Concentric layer 18 has a very much greater cross-section than layer 17, but a smaller concentration of steel balls and therefore could be interpreted falsely by a detection device. The outer concentric layer 19 has an even smaller concentration of balls, but the first moment about the center centrum is great, which could lead to a false conclusion by a detection device.

Figure 4:
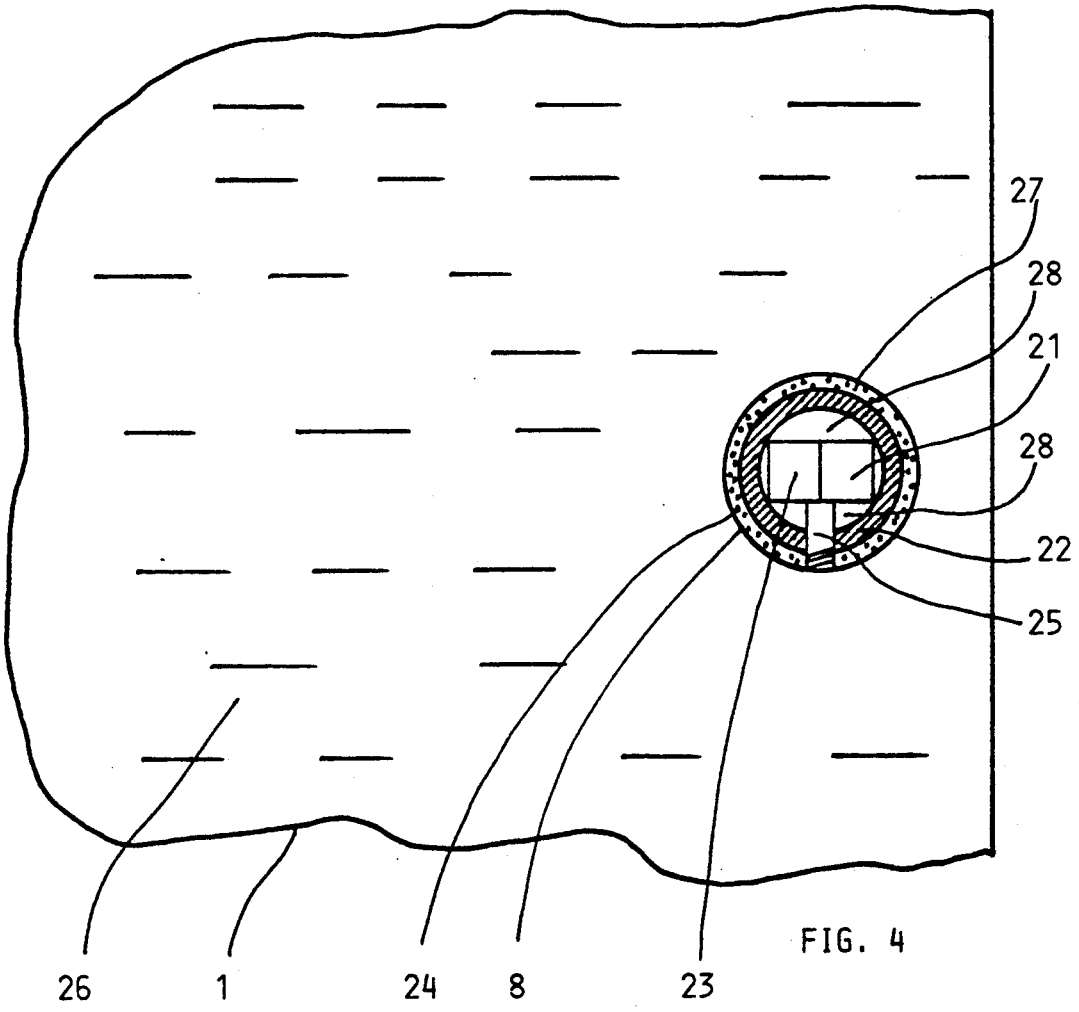
FIG. 4 shows a typical miniaturized controller with an aid for locating the mine at some future time.

FIG. 4 illustrates a mine in its expanded state, with a mixture of expansion material and explosives 26 within the shell 1 and the control logic and detonator 8 in the approximate center of the mine. The figure illustrates the position of the programmable control device 21, a detonator 22 and detonation controller 23, ferromagnetic material 24, and a replaceable battery 25 within the unit 8; electrical connections are not shown in the figure. Within the spherical volume 27 are soft iron filings, which may have an optimal sonar-reflecting form, which will penetrate the expansion material after detonation of the detonator 22, which fills the spherical space between the space 27 and the spherical logic space 28 with the controllers 21 and 23. Detonation is controlled by a detonation controller 23, which is only necessary, according to international convention, for those mines which are true mines are not decoys. Controller 21, and controller 23 if it is available, are programmed via a control computer of the releasing vessel or aircraft prior to release of the mine.

Figure 5:
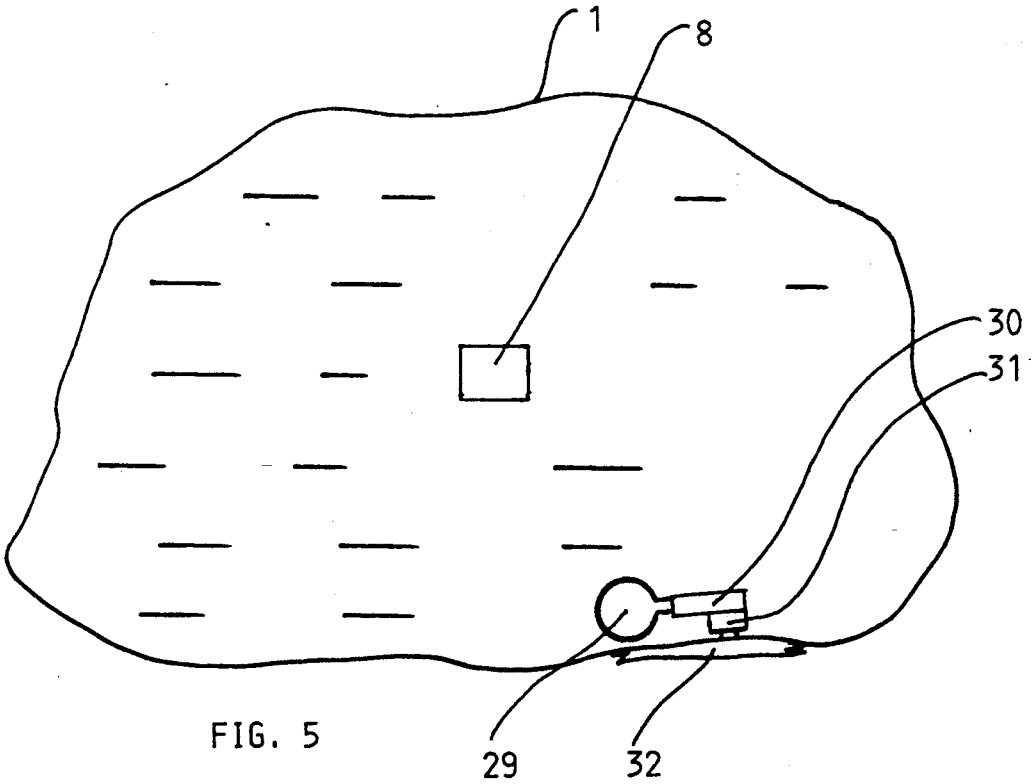
FIG. 5 shows a method for allowing the mine to rise.

FIG. 5 illustrates a method for allowing the mine to rise. A compressed air container 29 is loosely attached to the mine shell 1 via the valve 31 and its actuator 30. Surrounding the valve is an expansion bladder 32, firmly attached to the mine shell 1 at the position shown. When the actuator 30 receives the signal from the controller 21 which is illustrated in FIG. 4 within the control logic of space 8, it opens the valve 31 and allows the bladder to fill with the compressed air. After a pre-programmed time, the actuator may receive a command from the controller 21 to close the valve. This operation may be repeated by the controller.

Figure 6:
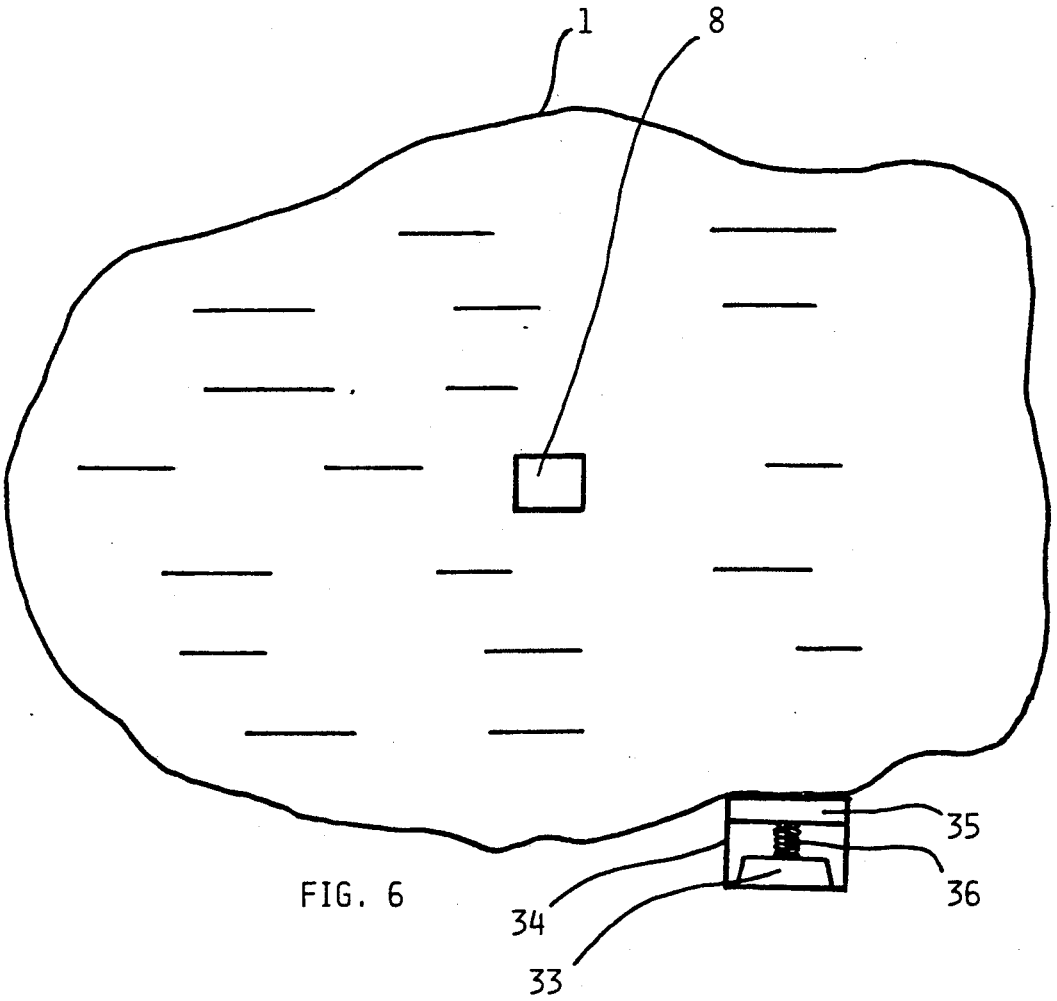
FIG. 6 illustrates attachment or a weight mechanism to a flexible mine.

FIG. 6 illustrates the use of a tethered weight 33 within a casing 34 attached to the mine in order to allow the mine to rise to a pre-determined depth. When a current is applied to the release mechanism 35, the weight 33 is free to drop out of its casing. If the mine is now enabled to rise, as illustrated and described above in the FIG. 5 description, the weight will remain stationary and the coiled tether 36 will pay out until it reaches its end or limit, or until the controller within the logic space 8 commands the breaking mechanism to stop the ascent, i.e. by removing the current. This combined releasing and breaking mechanism is a simple solonoid-controlled device; stop and speed control mechanism, as well as advice for combining them, are to be found in "Product Engineering Design Manual", Greenwood (McGraw-Hill), Chapter 10, as well as in numerous mechanical engineering and hobby manuals.

Figure 7:
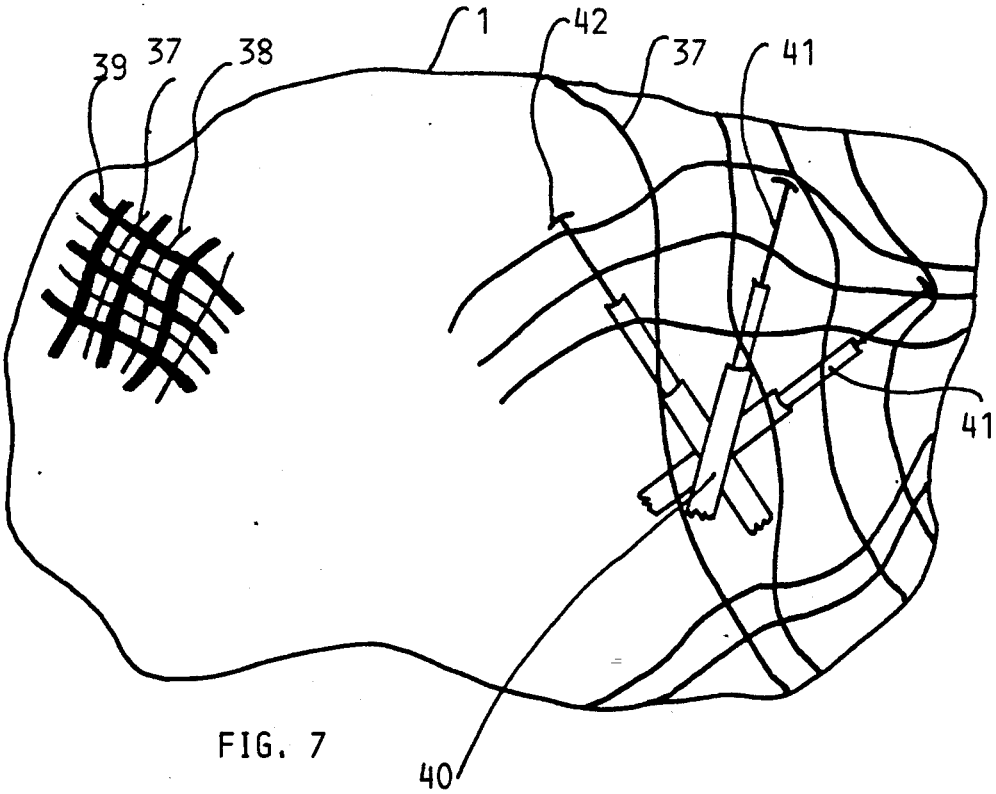
FIG. 7 illustrates an economical, sonar-reflecting decoy.

FIG. 7 shows a very simple mine embodiment which makes it ideal as an economical decoy. The outer mine shell 1, with Kevlar webbing 37 woven with silver thread 38 and/or ribbon 39 in order to reflect sonar signals, is in a collapsible form until released, after which it expands due to the expansion of the telescopic spring elements 41 of the expansion device 40. Only the decoy in its fully expanded form is shown. Since the shell 1 is made of relatively course webbing, there is no need to compensate for water pressure from outside or expansion pressures from expansion materials inside the shell, and the speed of expansion is immaterial. The expansion device 40 may contain folding elements as in an automatic opening umbrella, or other spring-loaded telescoping devices, such as self-adjusting bookshelf bookends, welded together and adapted to the instant application and shown in the figure. Other methods of expansion include the use of clock-springs, which need only be extracted from their restraining rings, after which they expand in the general form of a ball of tangled spring, thus forcing the shell 1 into a cylindrical form; such a tangle of spring ribbon would tend to confuse a sonar detector, thus causing a loss of time in the mine clearing process. The expansion device 40, many of which may be used but only shown singularly in the figure, has telescoping expansion elements 41, spring-loaded by coiled springs (not shown), and whose padded ends 42 push the skin of the shell 1 out to the desired shape after the expansion. At release and before expansion, the elements are held in their collapsed position by water soluble latches, which dissolve in seawater and allow expansion of the elements 41.

Figure 8:
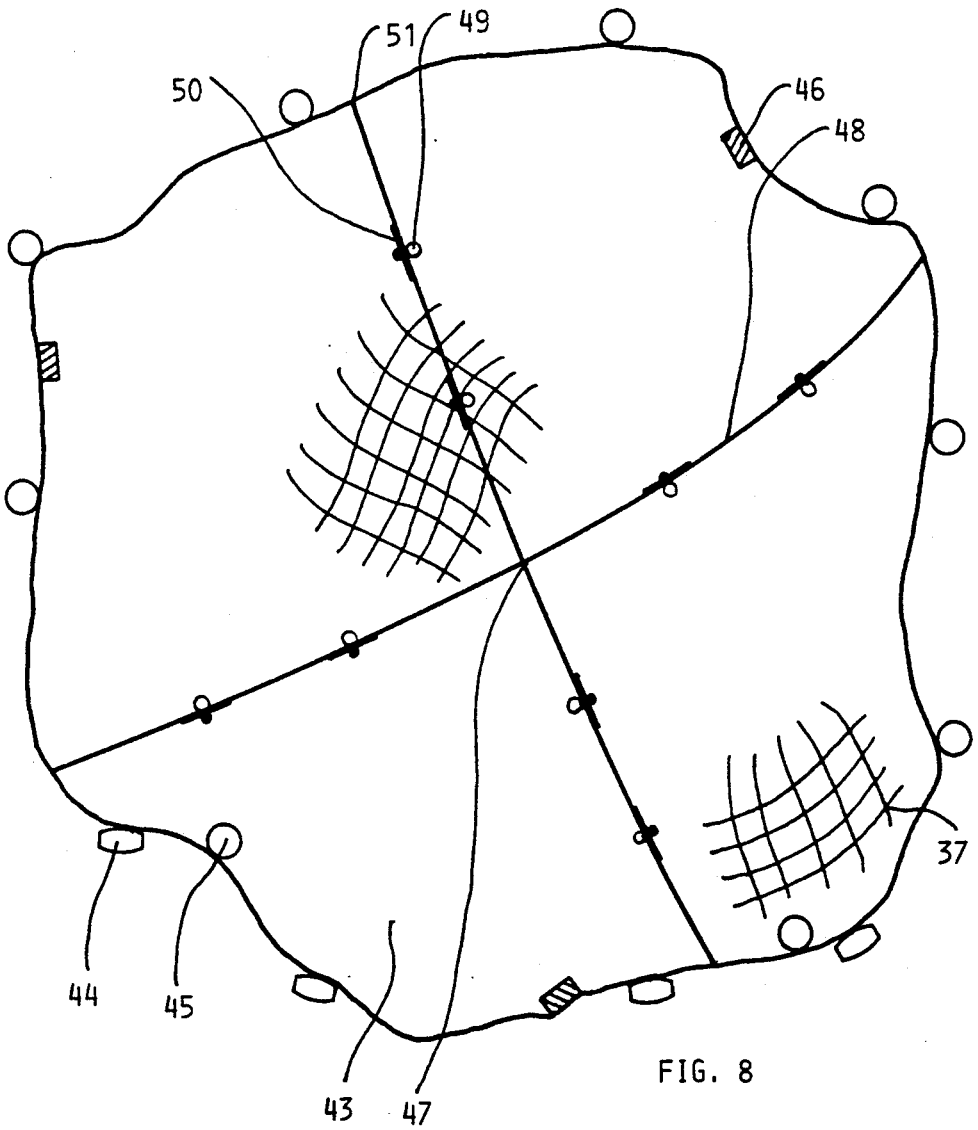
FIG. 8 illustrates an anti-torpedo curtain based on the principles of the instant underwater mine.

The form of the mine is not limited to the closed form described above. For example, FIG. 8 illustrates a compressed anti-torpedo curtain 43 which could be released by a submerged submarine on detection of a threatening torpedo. The curtain could have the closed form described above, in a relatively flat embodiment; it may also be a simple sheet of tough webbed material 37, weighted on one or more edges with weights 44 (four are shown) and buoyed with expansion flotation elements 45 on the other edges. After ejection underwater, the curtain would achieve a more or less vertical orientation at the position and time calculated by the submarine's data processing system. A leaf spring construction 47 with a plurality of unfoldable elements 48, connected by joints 49, and actuating springs 50, serves to rapidly expand the curtain immediately after ejection. The extremeties of the arms are attached to the periphery of the curtain at points 51. After the curtain's electronic controllers with sensors 46 (three are shown in the figure) have detected impact as measured by the accelerometers mentioned below, the edge flotation elements 45 would then be inflated rapidly to create a series of sea anchors at the periphery of the curtain, thus in effect capturing the torpedo or rendering it harmless to the submarine. Not shown is the collapsed form of the sea anchor or the expanded form, which when opened would resemble the nylon sea anchors typically used for small motor boats. The three sensors 46 and their associated controllers, batteries and wires to the flotation elements are likewise not illustrated in detail; typical ultraminiature controllers in the military arsenal have been mentioned above, while the motion sensors used to detect impact may be of the Type 3021-020-P micromechanical accelerometer from the company IC Sensors, or its equivalent from Litton Industries, Inc. The decentralized controllers are gang-programmed by the submarine control system shortly before release; the fine cables for this purpose, severed at launch, are not illustrated. Also not shown is the release mechanism for the sea anchor, since only release and no powered expulsion is necessary; for this purpose, retaining and locking detents and similar locking and releasing mechanisms may be found in "Mechanisms, Linkages, and Mechanical Controls", Chapter 12, Chironis, McGraw-Hill as well as in numerous other mechanical engineering and hobby manuals.

Although the expandable materials and their expansion mechanisms, the material for the outer shell and the internal strengthening and containers, and explosives nave been described according to the known state of the art, the invention is not limited to these materials, and new or improved materials and processes may be used in the future according to the teachings of the present invention. In particular, future expansion materials exhibiting very low buoyancy characteristics would serve to reduce the required counterweighting.

What is claimed is:

1. Underwater mine decoy, characterized by an expandable material and an outer shell formed by a webbed foldable material, the final shape of the mine decoy being determined by the limitations imposed by the outer shell.

2. Underwater mine decoy according to claim 1, characterized by using an expandable material which expands on contact with saltwater.

3. Underwater mine decoy according to claim 1, characterized by using said expandable material which expands due to a sudden pressure differential.

4. Underwater mine decoy according to claim 1, wherein the outer shell material is formed of one of steel, non-ferrous metal or plastic webbing material.

5. Underwater mine decoy according to claim 1, characterized by employing for said expandable material a mixture of expandable material and an entrained explosive material.

6. Underwater mine decoy according to claim 1, characterized by employing for said expandable material a mixture of expandable material and entrained iron powder, iron particles or a similar ferromagnetic material.

7. Underwater mine decoy according to claim 1, characterized by employing for said expandable material a mixture of expandable material and entrained sonar reflecting material.

8. Underwater mine decoy according to claim 1, characterized by employing said expandable material mixed with a ferromagnetic material such that the mine decoy exhibits a ferromagnetic gradient.

9. Underwater mine decoy according to claim 1, characterized by employing said expandable material mixed with one of sonar reflecting material and ferromagnetic material such that the mine decoy exhibits a sonar transmission gradient or a ferromagnetic gradient, respectively, said gradient being created by employing a plurality of concentric shells within said outer shell, and employing a varying amount of said ferromagnetic and/or said reflecting material in the expandable material between said shells.

10. Underwater mine decoy according to claim 1, characterized by employing a programmable control device contained within the outer shell which is constructed to withstand high water pressure and which controls the various logical decisions within the mine decoy.

11. Underwater mine decoy according to claim 1, characterized by employing a device contained within the outer shell which has a detonator and a detonation controller in combination with an explosive material and an amount of ferromagnetic and/or sonar reflecting material within the mine to facilitate relocation of the mine.

12. Underwater mine decoy according to claim 1, further characterized by an explosive material contained within the outer shell.

13. Underwater mine decoy according to claim 12, characterized by using a detonator and a detonation controller connected to the explosive material within the mine.

* * * * *